US005435688A

United States Patent [19]

Tokunaga et al.

[11] Patent Number: 5,435,688

[45] Date of Patent: Jul. 25, 1995

[54] BAR-LIKE ARTICLE SUPPLYING APPARATUS

[75] Inventors: Osamu Tokunaga, Chiba; Shigemitsu Hirama, Tokyo; Fujio Fukamizu, Kanagawa, all of Japan

[73] Assignees: Tokyo Automatic Machinery Works Limited; Japan Tobacco Inc., both of Tokyo, Japan

[21] Appl. No.: 94,192

[22] PCT Filed: Apr. 28, 1993

[86] PCT No.: PCT/JP93/00563

§ 371 Date: Jul. 29, 1993

§ 102(e) Date: Jul. 29, 1993

[87] PCT Pub. No.: WO93/22199

PCT Pub. Date: Nov. 11, 1993

[30] Foreign Application Priority Data

Apr. 30, 1992 [JP] Japan ..... 4-111596

[51] Int. Cl.[6] ..... B65B 19/04

[52] U.S. Cl. ..... 414/419; 414/421; 414/403; 414/758; 414/773; 414/774; 414/745.7

[58] Field of Search ..... 414/403, 404, 405, 407, 414/408, 745.11, 745.7, 409, 573, 574, 410, 419, 420, 355, 356, 421, 422, 746.8, 745.8, 423, 424, 774, 425, 762, 754, 758, 759, 763, 764, 729, 765, 766, 771, 773, 783

[56] References Cited

U.S. PATENT DOCUMENTS

| | | | |
|---|---|---|---|
| 2,473,955 | 6/1949 | Kendall | 414/419 X |
| 3,486,647 | 12/1969 | Seragnoli | 414/419 X |
| 3,550,799 | 12/1970 | Marradi | 414/421 X |
| 3,655,080 | 4/1972 | Gianese | 414/421 X |
| 3,883,017 | 5/1975 | Shirai et al. | 414/421 X |
| 4,986,718 | 1/1991 | Kumata et al. . | |

FOREIGN PATENT DOCUMENTS

| | | | |
|---|---|---|---|
| 213264 | 6/1960 | Austria | 414/421 |
| 1-38471 | 8/1989 | Japan . | |
| 3-12744 | 3/1991 | Japan . | |

OTHER PUBLICATIONS

International Search Report in English and Japanese.

*Primary Examiner*—Frank E. Werner

*Attorney, Agent, or Firm*—Sandler, Greenblum & Bernstein

[57] ABSTRACT

A bar-like article supplying apparatus is constructed such that a tray is carried in while remaining in an erected condition on a dolly, which moves intermittently. The tray is open at an upper face thereof and is turned over and fed to drop and supply bar-like articles from the tray into a supply port. Then, the inverted tray is turned over and fed so as to be returned into an erected condition and then is carried out to a dolly while remaining in the erected condition. After the tray is carried into an occupied tray turning over mechanism by a carrying-in mechanism, the occupied tray turning over mechanism is turned over, and consequently, the inverted tray is in an inverted condition just above the supply port so that supply of the bar-like articles is started. When the tray during such supplying is transferred to an empty tray turning over mechanism, the occupied tray turning over mechanism is turned over back to allow a next tray to be carried in.

10 Claims, 13 Drawing Sheets

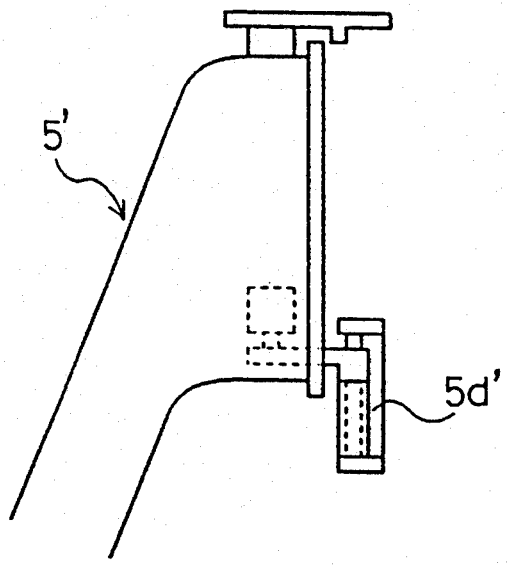
FIG. 11
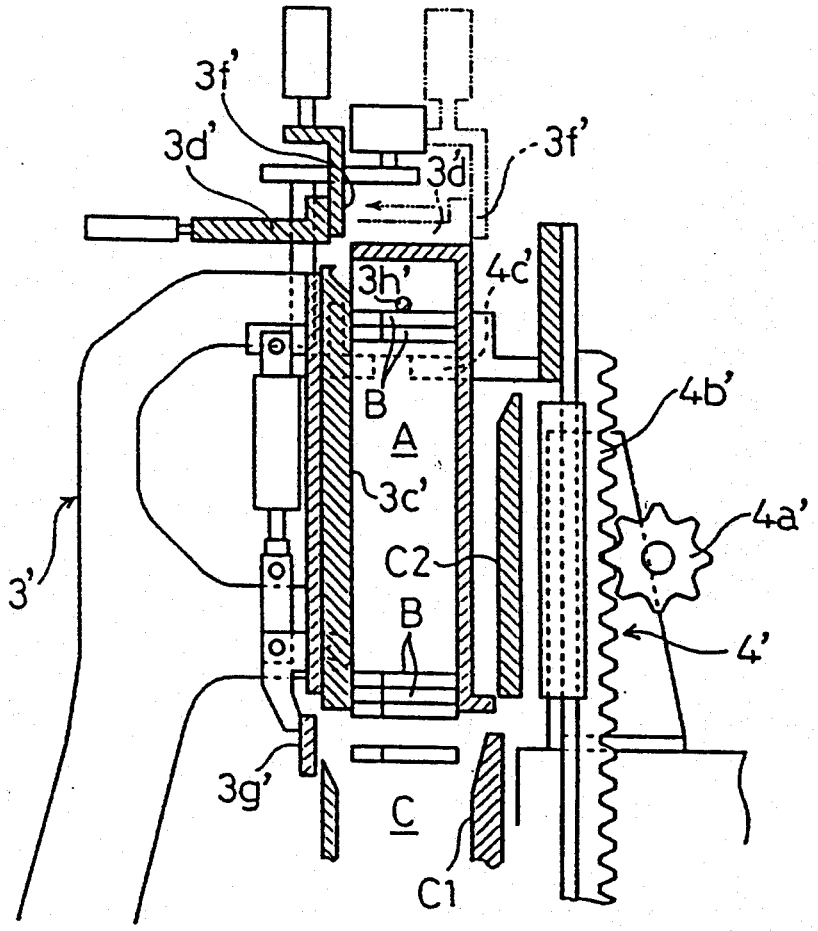

BAR-LIKE ARTICLE SUPPLYING APPARATUS

FIELD OF THE INVENTION

This invention relates to a bar-like article supplying apparatus which supplies bar-like articles such as, for example, cigarettes or filter plugs into a supply port of a hopper or the like, and more particularly to a bar-like article supplying apparatus of the type wherein a tray which has been carried in an erected condition from a dolly, which travels intermittently, and is open at the top thereof is turned over and fed to drop and supply bar-like articles in the tray into a supply port. The tray in the inverted condition is turned over and fed back into the erected condition and is carried out onto the dolly while leaving the tray in the erected condition.

DESCRIPTION OF BACKGROUND ART

Conventionally, as a bar-like article supplying apparatus of the type mentioned, there is a bar-like article supplying apparatus which includes as disclosed, for example, in Japanese Patent Publication No. Heisei 1-38471, a lift holder disposed between a dolly and a supply port and having two tray holders mounted in an upwardly and downwardly symmetrical relationship thereon, such that the two holders are moved upwardly or downwardly while being turned spirally by 180 degrees, a first transport mechanism for transferring a tray horizontally from the dolly to the lower side tray holder of the lift holder, a rotary member for holding two tray holding frames in an upwardly and downwardly symmetrical relationship thereon and intermittently turning them over by 180 degrees, and a second transport mechanism for transferring a tray horizontally from the upper side tray holder of the lift holder to the corresponding tray holding frame in an erected condition of the rotary member.

In the bar-like article supplying apparatus, a tray in an inverted condition and another tray in an erected condition are individually held on the two tray holding frames of the rotary member, and while the rotary member is turned over and bar-like members are dropped and supplied from the tray in the inverted condition into the supply port, the emptied tray is returned from the tray holding frame in the erected condition to the upper side tray holder of the lift holder by the second transport mechanism. Then, the lift holder is turned and moved upwardly or downwardly to feed the empty tray to a lower limit position and simultaneously feed a next tray to an upper limit position, whereafter the next tray having arrived at the upper limit position is placed into the tray holding frame in the erected condition by the second transport mechanism. Simultaneously, the empty tray having arrived at the lower limit position is carried out into the dolly by the first transport mechanism, and then the dolly travels by a fixed pitch to carry a tray, which corresponds to a second next tray, from the dolly into the lower side tray holder of the lift holder by the first transport mechanism. Thereafter, the operations described above are repeated.

In such a conventional bar-like article supplying apparatus as described above, however, since a bar-like article cannot be supplied from the dolly to the supply port without passing the two carrying-in steps, the turning and upwardly moving step and the turning over step, the tray feeding distance from the dolly to the supply port is long, and there is a problem in that not only the construction of the apparatus is complicated and the overall size of the apparatus is great as much but also the cost is high.

Further, since it is necessary to turn and move the empty tray and next tray downwardly and upwardly, after an empty tray is carried out from the rotary member to the lift holder during supplying of bar-like articles from another tray, respectively, and then to carry the next tray from the lift holder into the rotary member to prepare the next tray, much time is required to complete preparations of the next trays, and besides, supply of next bar-like articles cannot be started unless the rotary member is turned over. If the processing rate of bar-like articles supplied is increased so that the time after starting until ending of supply of bar-like articles is shortened, a period of time for which no supply takes place occurs after supply of a tray for one carton is started until supply of a next tray is started, resulting in intermittent supply. As a result, a decrease of the processing rate of bar-like articles supplied to a rate at which supply of bar-like articles occurs continuously, and consequently, there is a problem in that an increase of the overall processing rate cannot be anticipated.

Accordingly, it is an object of the present invention to provide a bar-like article supplying apparatus wherein the tray feeding distance for feeding a tray from a dolly to a supply port is shortened and a next tray is prepared in a short time during supplying.

SUMMARY OF THE INVENTION

According to the present invention, after a tray is carried from a dolly into an occupied tray turning over mechanism by a carrying-in mechanism, the occupied tray turning over mechanism is turned over to turn over the tray into an inverted condition just above a supply port so that supply of bar-like articles is started, and when the tray during supplying is transferred to an empty tray turning over mechanism, the occupied tray turning over mechanism is turned over back to allow a next tray to be carried in, and consequently, the tray feeding distance for feeding a tray from the dolly to the supply port can be made short and a next tray can be prepared in a short interval of time during supplying.

Further, according to the present invention, since a tray during supplying is moved up by a lifting mechanism while leaving it in an inverted condition, all of bar-like articles go out rapidly from within the tray into the supply port to allow the emptied tray to be turned over, the cycle time can be further reduced by a time by which turning over of the empty tray occurs earlier.

BRIEF DESCRIPTION OF THE DRAWINGS

FIG. 11 is a partial enlarged vertical sectional front elevational view showing a condition upon starting of supplying.

DETAILED DESCRIPTION OF THE INVENTION

Figure 1:
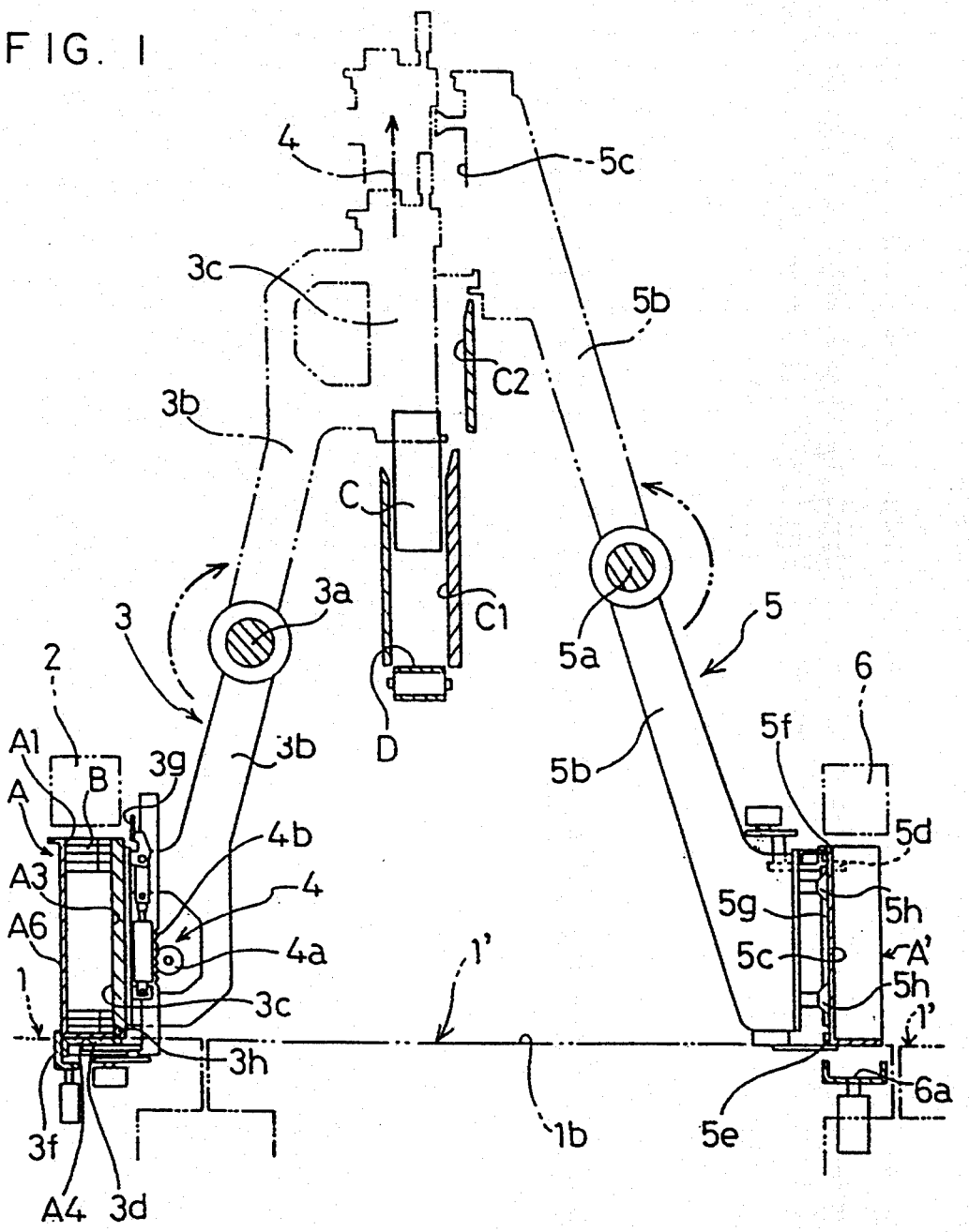
FIG. 1 is a vertical sectional front elevational view of a preferred bar-like article supplying apparatus according to the present invention and shows the apparatus immediately after a dolly travels forwardly.

In order to describe the present invention in more detail. It will be described with reference to the accompanying drawings.

In an apparatus shown In FIGS. 1 to 3, cigarettes are filled as bar-like articles B into a tray A' in an empty condition (hereinafter referred to as an empty tray) which is open at an upper face and a front side face thereof, and a supply port C is disposed at a position higher than an upper face 1*a* of a dolly 1 onto which the thus filled up tray A (hereinafter referred to as an occupied tray) is placed. The bar-like articles B dropped and supplied from the occupied tray A into the supply port C are fed horizontally by a transport belt D, which lies horizontally from a lower end of the supply port C to a hopper E of a packaging machine, so that they are fed and supplied into the hopper E of the packaging machine. A turning over center shaft 3*a* which serves as the center of turning over motion of an occupied tray turning over mechanism 3 and another turning over center shaft 5*a* which serves as the center of turning over motion of an empty tray turning over mechanism 5 are disposed in parallel to each other at positions opposed to each other across the supply port C and provided for individual rocking motion in the same directions.

The dolly 1 is disposed for movement along the linear transport passage 1*a* and receives a plurality of occupied trays A or/and empty trays A' on an upper face 1*b* thereof at predetermined intervals in an advancing direction of the dolly 1 such that they can be delivered in a horizontal direction perpendicular to the advancing direction. The dolly 1 is intermittently moved forwardly by a preset distance by a feeding mechanism (not shown) after starting of operation of a carrying-in mechanism 2 which will be hereinafter described so that succeeding occupied trays A are successively moved to the position opposed to the carrying-in mechanism 2 while empty trays A' are successively moved in the advancing direction from the position opposed to a carrying-out mechanism 6 which will be hereinafter described.

In the example shown, the length of the dolly 1 in the advancing direction is formed shorter than the horizontal distance from the carrying-in mechanism 2 to the carrying-out mechanism 6, and a plurality of such dollies 2 are connected to each other such that the position opposed to the carrying-in mechanism 2 of a succeeding dolly 1 and the position opposed to the carrying-out mechanism 6 of a preceding dolly 1 after the succeeding dolly 1 is moved forwardly by one pitch may be the same positions between the preceding and succeeding dollies 1, 1. Further, upon starting of operation, a dolly 1' in an empty condition into which empty trays A' are to be collected is connected to the top of a plurality of dollies 1 on which occupied trays A are placed.

The carrying-in mechanism 2 and the carrying-out mechanism 6 are installed in parallel and in a horizontal direction perpendicular to the advancing direction of the dollies 1, 1' and each has an arresting piece 2*a*, 6*a* mounted for back and forth movement in a horizontal direction perpendicular to the advancing direction of the dollies 1, 1' for engaging with an angle portion A2 provided projectingly at an end edge of an upper face opening A1 of an occupied tray A or an empty tray A'. The carrying-in mechanism 2 carries, after turning over and downward movement of the occupied tray turning over mechanism 3 which will be hereinafter described, an occupied tray A from a dolly 1 into a tray holding frame 3*c* of the occupied tray turning over mechanism 3, and The carrying-out mechanism 3 carries out, after turning over and downward movement of the empty tray turning over mechanism 5 which will be hereinafter described, an empty tray A' from within a tray holder 5*c* of the empty tray turning over mechanism 5 onto a dolly 1' in an empty condition.

In the occupied tray turning over mechanism 3, the turning over center shaft 3*a* which is associated with a control motor (not shown) and driven to rotate intermittently in the forward and reverse directions is installed horizontally in parallel to the carrying-in mechanism 2, and a pair of rocking arms 3*b* are provided projectingly for rocking motion in upward and downward directions on the turning over center shaft 3*a*. A tray holding frame 3*c* for removably holding an occupied tray A is provided contiguously to ends of the rocking arms 3*b*, and the rocking arms 3*b* are rocked by rotation of the turning over center shaft 3*a* to turn over and reciprocate the tray holding frame 3*c* from a lower limit position opposed to the carrying-in mechanism 2 to an upper limit position corresponding to the position just above the supply portion C.

The tray holding frame 3*c* of the occupied tray turning over mechanism 3 is formed as a flat plate which covers over a front face opening A3 of an occupied tray A, and a cover plate 3*d* opposed to the bottom face A4 is provided projectingly in an L shape in side elevation while the face opposed to the dolly 1 is open. Further, a pair of holding pieces 3*e*, 3*e* mounted for movement into and out of contact with the left and right side faces A5, A5 of the occupied tray A to engage and hold the occupied tray A are provided contiguously for opening and closing movement. A stopper 3*f* mounted for movement into and out of contact with a bottom portion of the rear side face A6 of the occupied tray A to engage and hold the occupied tray A is provided contiguously for advancing and retracting movement on the cover plate 3*d*. Further, a lid 3*g* mounted for opening and closing movement for closing the upper face opening A1 of the occupied tray A and a disorder preventing rod 3*h* mounted for movement into and out of the occupied tray A to contact with the top faces of the bar-like articles B are contiguously provided.

And, the occupied tray turning over mechanism 3 causes, in its initial condition, the tray holding frame 3*c* to wait at the lower limit position and pushes out the stopper 3*f* and moves the lid 3*g* into an open condition while moving the holding pieces 3*d*, 3*d* in an opening direction to positions at which they do not interfere with an occupied tray A to be carried in, and then moves, after completion of operation of the carrying-in mechanism 2, the holding pieces 3*e*, 3*e* and the lid 3*g* individually in closing directions, whereafter it turns over and moves up the tray holding frame 3*c* from the lower limit position to the upper limit position.

Further, after the turning over and upward movement is completed, the lid 3*g* is opened immediately after starting of operation of the lifting mechanism 4 which will be hereinafter described, and then, after the holding pieces 5*d*, 5*d* of the empty tray turning over mechanism 5, which will be hereinafter described, are moved into a closing direction, the occupied tray turning over mechanism 3 retracts the stopper 3*f* while moving the holding pieces 3*e*, 3*e* in the opening direction, whereafter it turns over and moves down the tray holding frame 3*c* from the upper limit position to the lower limit position and then pushes out, before starting of operation of the carrying-in mechanism 2, the stopper 3*f* to restore the initial condition.

The lifting mechanism 4 is provided integrally with the occupied tray turning over mechanism 3 such that the tray holding frame 8*c* is supported for reciprocative movement in the upward and downward directions on the rocking arms 3*b* of the occupied tray turning over mechanism 3, and pinions 4*a* associated with a control motor (not shown) and racks 4*b* are interposed between the rocking arms 3*b*. The lifting mechanism 4 moves and causes the tray holding frame 3*c* to wait at a position nearest to the turning over center shaft 3*a* in an initial condition of the lifting mechanism, and after turning over and upward movement of the occupied tray turning over mechanism 3, the pinions 4*a* are rotated to raise the tray holding frame 3*c* a little in a direction away from the turning over center shaft 3*a*, and after the lid 3*g* is opened, the tray holding frame 3*c* is moved up to a position of a predetermined height. Then, after starting of operation of the carrying-in mechanism 2, the tray holding frame 3*c* is moved in a direction toward the turning over center shaft 3*a* to restore the initial condition.

In the empty tray turning over mechanism 5, the turning over center shaft 5*a* which is associated with the control motor not shown and intermittently driven to rotate in the forward and reverse directions is installed horizontally in parallel to the carrying-out mechanism 6 above the turning over center shaft 3*a* of the occupied tray turning over mechanism 3, and a pair of rocking arms 5*b* longer than the rocking arms 3*b* are provided projectingly for rocking motion in the upward and downward directions on the turning over center shaft 5. A tray holder 5*c* for removably holding an occupied tray A or an empty tray A′ is provided contiguously to an end of the rocking arm 5*b*. When the turning over center shaft 5*a* is rotated, the rocking arms 5*b* are rocked in the same direction as the rocking direction of the occupied tray turning over mechanism 3 to turn over and reciprocate the tray holder 5*c* from an upper limit position just above the supply port C in which the tray holder 5*c* is opposed to the tray holding frame 3*c* moved up by the lifting mechanism 4 to a lower limit position opposed to the carrying-out mechanism 6.

The tray holder 5*c* of the empty tray turning over mechanism 5 includes a pair of openable and closeable holding pieces 5*d*, 5*d* mounted for movement into and out of contact with the left and right side faces A5, A5 of an occupied tray A, which is open at the face thereof opposed to a dolly 1′ in an empty condition described above and has been put into an inverted condition by the turning over and upward movement of the occupied tray turning over mechanism 3, to engage and hold the occupied tray A, and bottom holding pieces 5*e* provided contiguously to the holding pieces 5*d*, 5*d* and mounted for advancing and retracting movement into and out of contact with a bottom portion of the rear side face A6 to engage and hold the occupied tray A. Further, in accordance with the necessity, positioning guides 5*f* opposed to the rear side face A6 and a reference guide 5*g* mounted for advancing and retracting movement are formed on a same vertical plane just above an inner side face C1 of the supply port C in a condition wherein the empty tray turning over mechanism 5 is turned over and moved upwardly, and suction cups 5*h* mounted for movement into and out of contact with the rear side face A6 of the occupied tray A to attract the occupied tray A are provided contiguously for advancing and retracting movement.

And, the empty tray turning over mechanism 5 causes, in its initial condition, the tray holder 5*c* to wait at the upper limit position and moves the holding pieces 5*d*, 5*d* in the opening direction while retracting the bottom holding pieces 5*e*, the reference guides 5*g* and the suction cups 5*h* to positions in which they do not interfere with the cover plate 3*d* moved up by the lifting mechanism 4 and an occupied tray A in an inverted condition, and then pushes out, after completion of lifting movement of the lifting mechanism 4, the reference guides 5*g* and the suction cups 5*h* in a direction to approach the rear side face A6 of the occupied tray A to attract the occupied tray A while moving the holding pieces 5*d*, 5*d* in the closing direction. Then, the suction cups 5*h* are slightly retracted until the rear side face A6 of the occupied tray A thus attracted is abutted with the pushed out reference guides 5*g*.

Further, after the occupied tray turning over mechanism 3 is turned over and moved down, the empty tray turning over mechanism 5 pushes out the bottom holding pieces 5*e*, and then turns over and moves down the tray holder 5*c* from the upper limit position to the lower limit position. After the turning over and downward movement is completed, the empty tray turning over mechanism 5 retracts the bottom holding pieces 5*e* and cancels, immediately after a carry-out rail 6*a*, which will be hereinafter described, is lifted, the attraction of the suction cups 5*h* while moving the holding pieces 5*d*, 5*d*, and then retracts the suction cups 5*h* together with the reference guides 5*g*. Then, immediately after operation of the carrying-out mechanism 6 is started, the empty tray turning over mechanism 5 turns over and moves up the tray holder 5*c* from the lower limit position to the upper limit position to restore the initial condition.

Below the carrying-out mechanism 6, a carrying-out rail 6*a* for an empty tray A′ turned over and moved down is installed horizontally for upward and downward movement in an opposing relationship to the bottom face A4 of the empty tray A′, and the carrying-out rail 6*a* waits, in its initial condition, at the lower limit position at which it does not interfere with the bottom holding piece 5*e* which is turned over and moves down below the upper face 1*b* of a dolly 1. Immediately after the occupied tray turning over mechanism 3 is turned over and moved down so that the bottom holding piece 5*e* is retracted, the carrying-out rail 6*a* is moved up to its upper limit position to be level with the upper face 1*b* of the dolly 1 into contact with the bottom face A4 of the empty tray A′, and then after completion of operation of the carrying-out mechanism 6, the carrying-out tray 6*a* is moved down to restore its initial condition.

Further, above the supply port C, a supply guide C2 is disposed In a parallel, opposed relationship to the rear side face A6 of an occupied tray A, which has been pull into an inverted condition by turning over and upward movement of the occupied tray turning over mechanism 3, for back and forth movement in a direction into and out of contact with the rear side face A6. The supply guide C2 in its initial condition is moved in a direction away from the rear side face A6 of an occupied tray A turned over and moved upwardly and then waits there, and then when it comes, by upward movement of the lifting mechanism, into a positional relationship wherein it does not interfere with the occupied tray A, it is moved to a position at which it lies on a same vertical plane as the inner side face C1 of the supply port C. Then, after turning over and downward movement of the empty tray turning over mechanism 5, the supply guide C2 is moved in the opposite direction to restore its initial condition.

Subsequently, operation of the bar-like article supplying apparatus shown in FIGS. 1 to 8 will be described.

First, in an initial condition, operation of the carrying-in mechanism 2 is started, and after an occupied tray A is carried into the tray holding frame 3*c* of the occupied tray turning over mechanism 3 from a dolly 1, the dollies 1 are advanced by one pitch and simultaneously the holding pieces 3*e*, 3*e* are closed to cooperate with the pushed out stopper 3*f* to hold the occupied tray A carried in so that it may not move, whereafter the lid 3*g* is moved in the closing direction to close up the upper face opening A1 of the occupied tray A.

Figure 4:
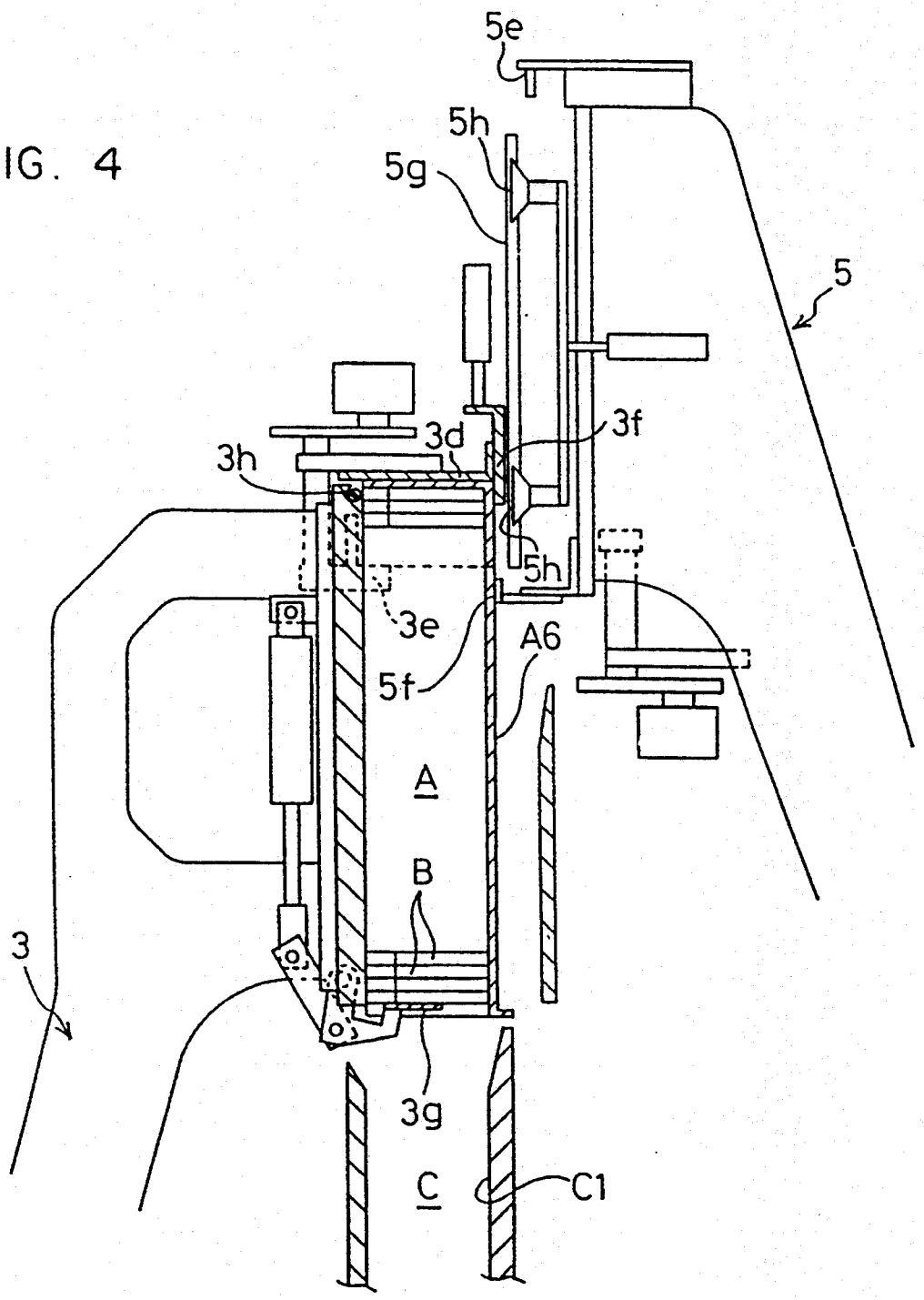
FIG. 4 is a partial enlarged vertical sectional front elevational view showing a condition immediately after an occupied tray turning over mechanism is turned over and moved up.

Thereafter, the occupied tray turning over mechanism 3 is turned over and moved up to put the occupied tray A into an inverted condition as shown in FIG. 4, and upon completion of the turning over and upward movement, the rear side face A6 of the occupied tray A abuts with the positioning guides 5*f* of the empty tray turning over mechanism 5 so that it is positioned just above the supply port C.

Figure 5:
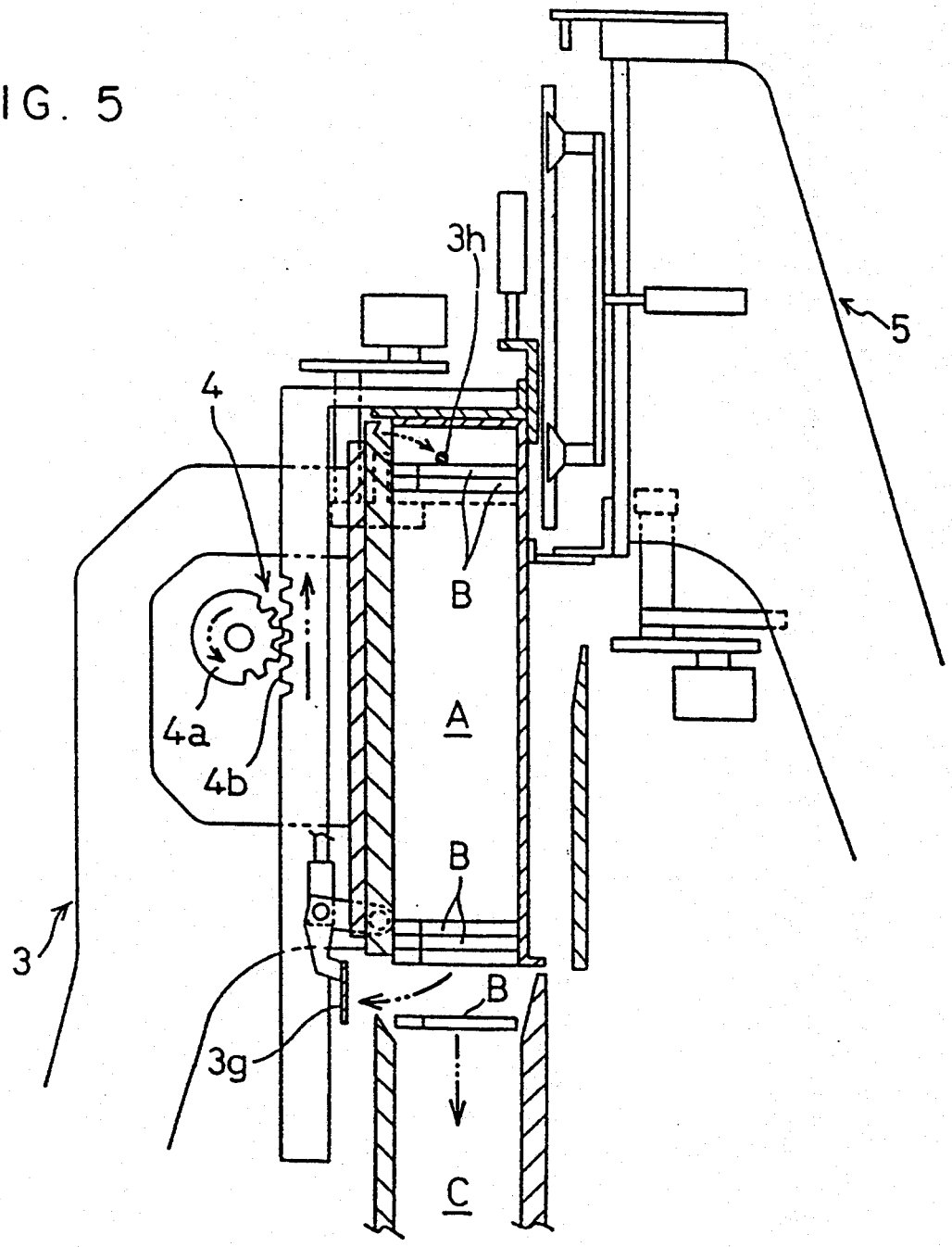
FIG. 5 is a partial enlarged vertical sectional front elevational view showing a condition upon starting of supplying.

Subsequently, operation of the lifting mechanism 4 is started to lift the occupied tray A in an inverted condition as shown in FIG. 5, and during such lifting movement, the lid 3*g* is moved an opening direction so that dropping a supply of bar-like articles B from within the occupied tray A into the supply port C is started while at the same time the disorder preventing rod 3*h* contacts the top faces of the bar-like articles B to prevent play of the bar-like articles B.

Figure 6:
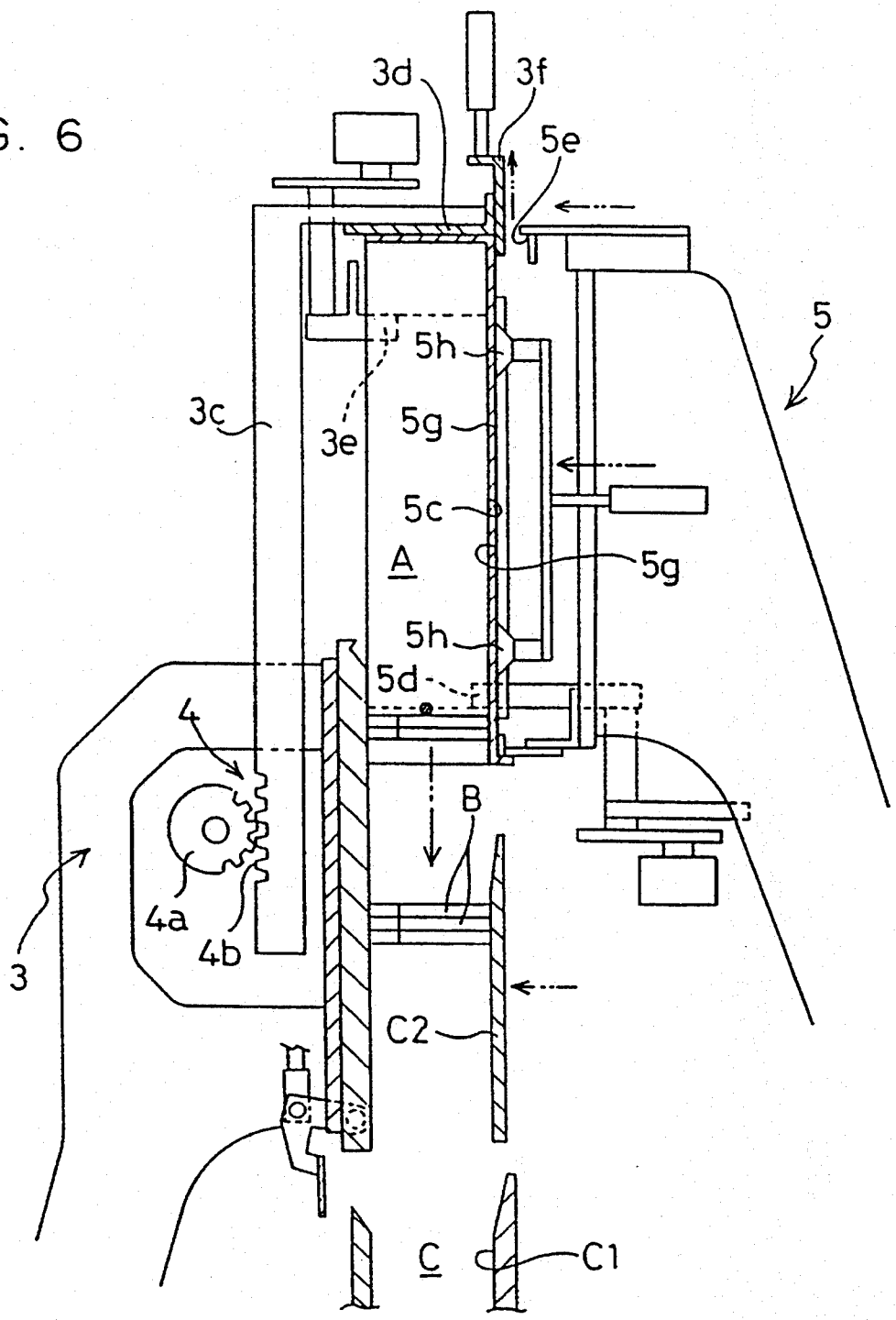
FIG. 6 is a partial enlarged vertical sectional front elevational view showing a condition immediately before transferring.

When the lifting movement of the occupied tray A by the lifting mechanism 4 comes near to its upper limit, the supply guide C2 is moved to a position on the same vertical plane as the inner side face C1 of the supply port C as shown in FIG. 6 to guide the bar-like articles B during dropping, and after the upward movement is completed, the holding pieces 5*d*, 5*d* of the empty tray turning over mechanism 5 are moved into a closing direction while at the same time the suction cups 5 attract the occupied tray A during supplying to hold the occupied tray A during supplying so that it may not move while positioning the occupied tray A just above the supply port C along the projected reference guide 5*g*.

Thereafter, the holding pieces 3*e*, 3*e* and the stopper 3*f* of the occupied tray turning over mechanism 3 are spaced away from the occupied tray A, and the occupied tray A during supplying is transferred from the tray holding frame 3*c* of the occupied tray turning over mechanism 3 to the tray holder 5*c* of the empty tray turning over mechanism 5. Immediately after the transfer, the occupied tray turning over mechanism 3 is turned over and moved down to its lower limit position, and the carrying-in mechanism 2 operates again to start carrying-in of a next occupied tray A from the dolly 1.

Figure 2:
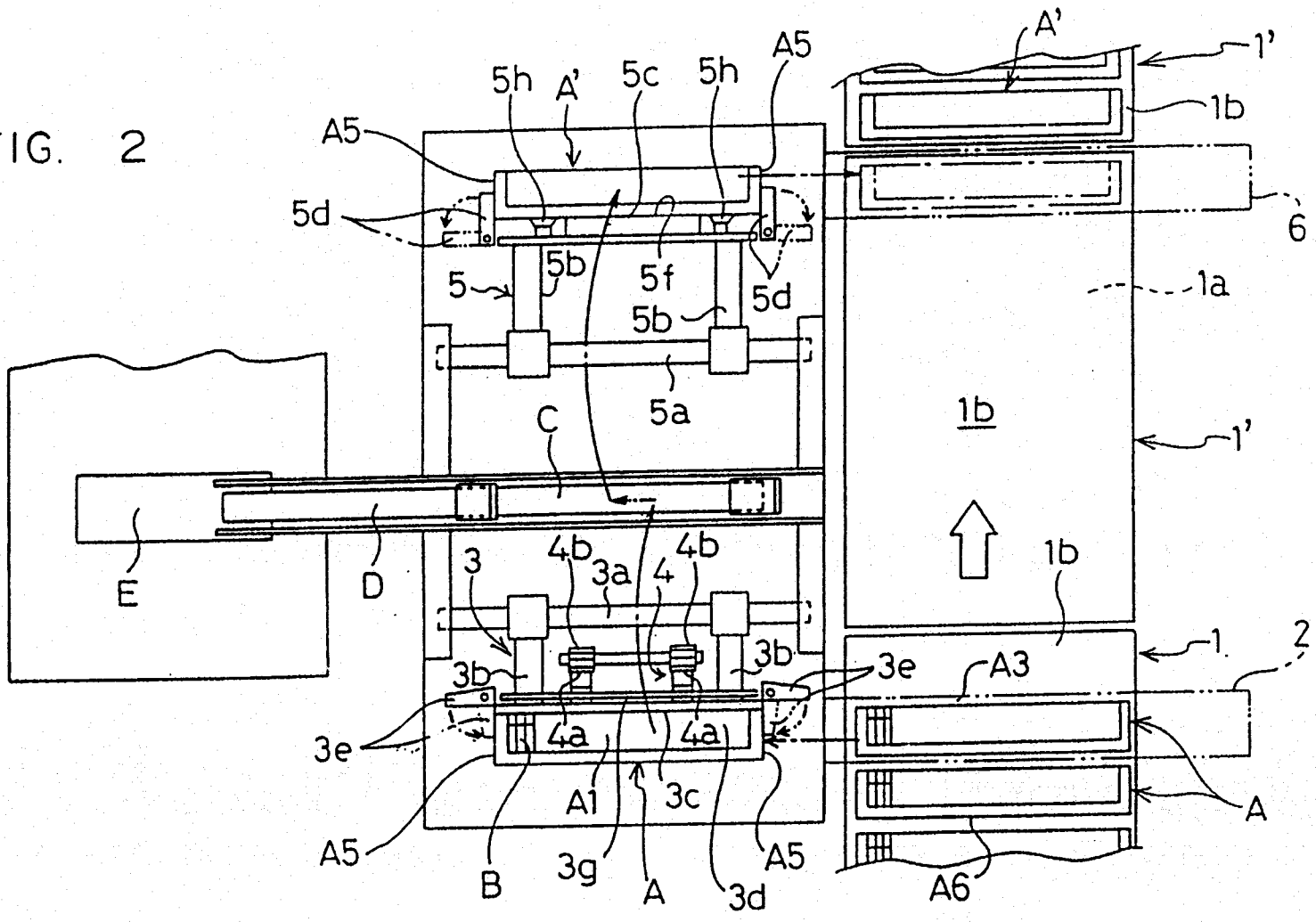
FIG. 2 is a reduced plan view of the apparatus.
Figure 3:
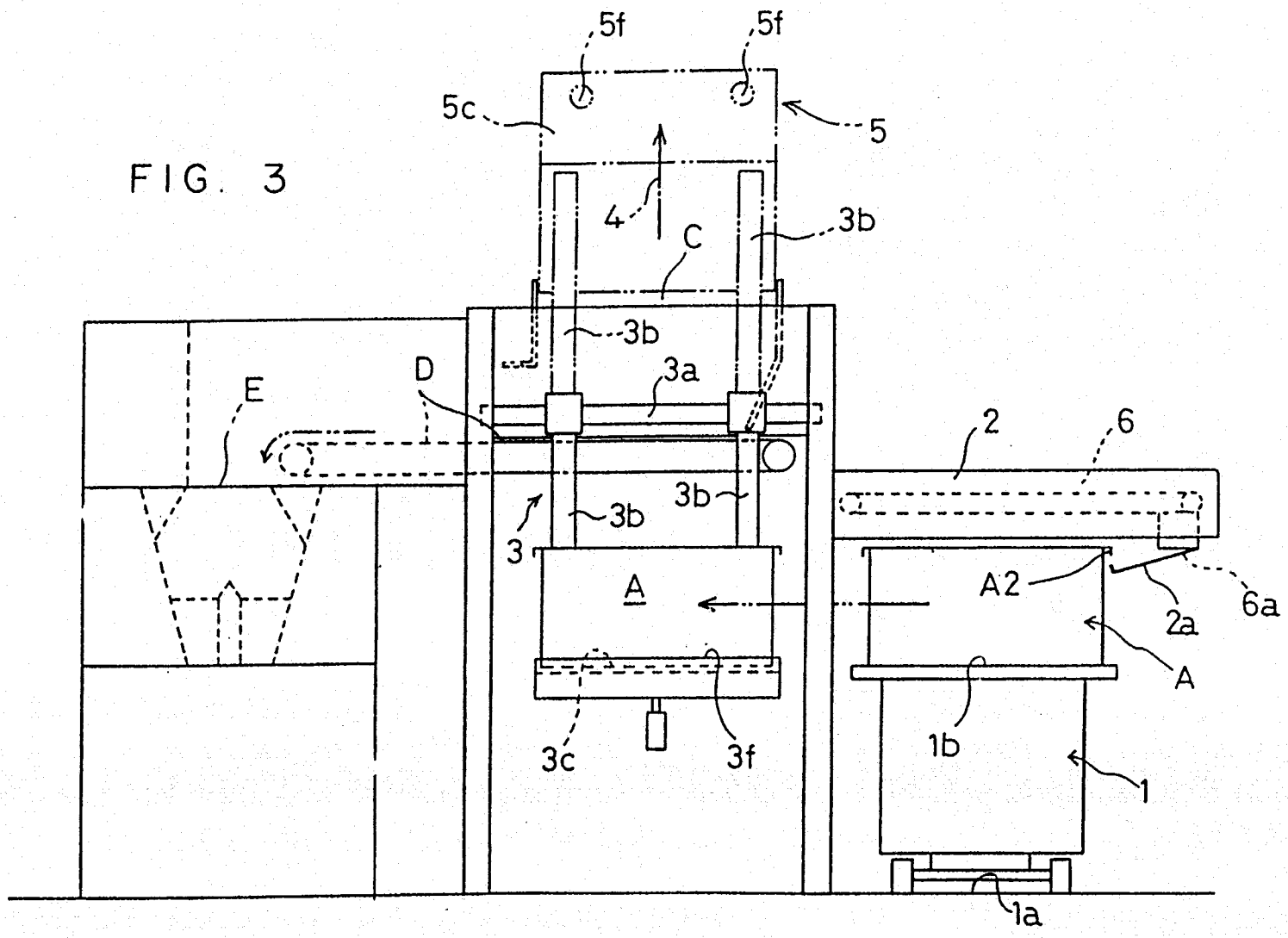
FIG. 3 is a reduced side elevational view of the apparatus.
Figure 7:
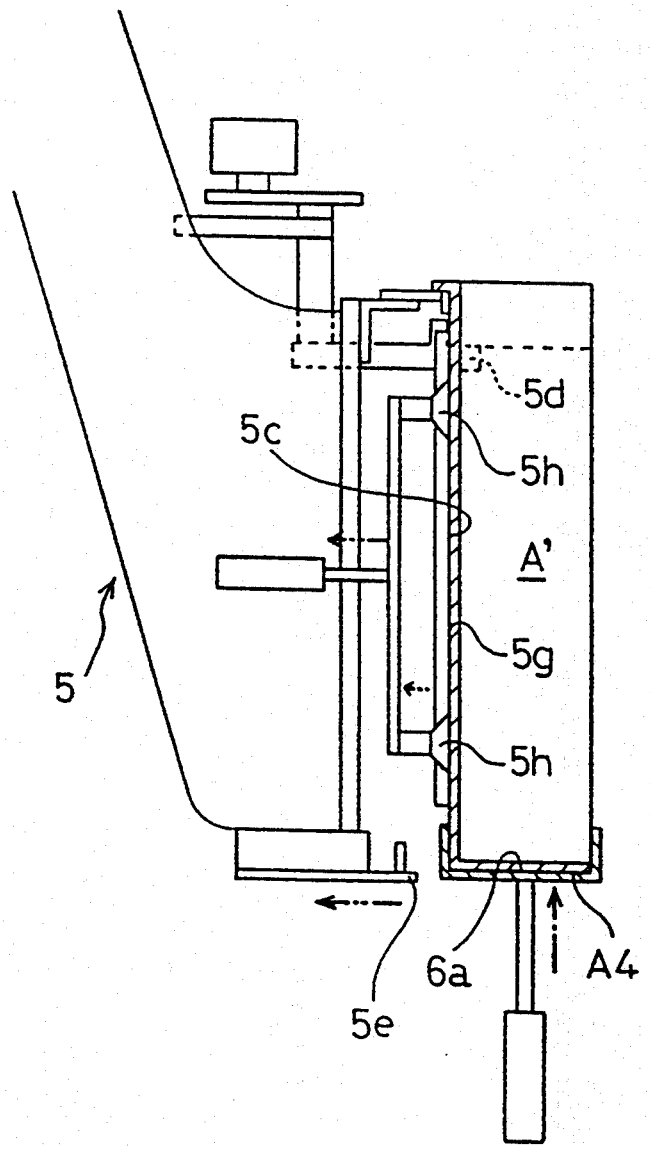
FIG. 7 is a partial enlarged vertical sectional front elevational view showing a condition immediately before carrying out.

Then, immediately after supplying of the bar-like articles B from within the occupied tray A is completed, the empty tray turning over mechanism 5 is turned over and moved down to return the empty tray A′ into an erected condition as shown in FIGS. 1 to 3, and immediately after completion of the turning over and downward movement, engagement between the bottom holding pieces 5*e* and the empty tray A′ is cancelled as shown in FIG. 7 and then the transport rail 6*a* is moved up. Immediately after that, the holding pieces 5*d*, 5*d* are opened and the attraction of the suction cups 5*h* is cancelled to allow movement of the empty tray A′.

Subsequently, operation of the carrying-out mechanism 6 is started, and the empty tray A′ is carried out from within the tray holder 5*c* of the empty tray turning over mechanism 5 onto a dolly 1′ in an empty condition, and simultaneously, when the empty tray A′ comes out from within the tray holder 5*c*, the empty tray turning over mechanism 5 is turned over and moved up and then waits there, and thereafter, the occupied tray turning over mechanism 5 is turned over and moved up, whereafter the operation described above is repeated.

Figure 8:
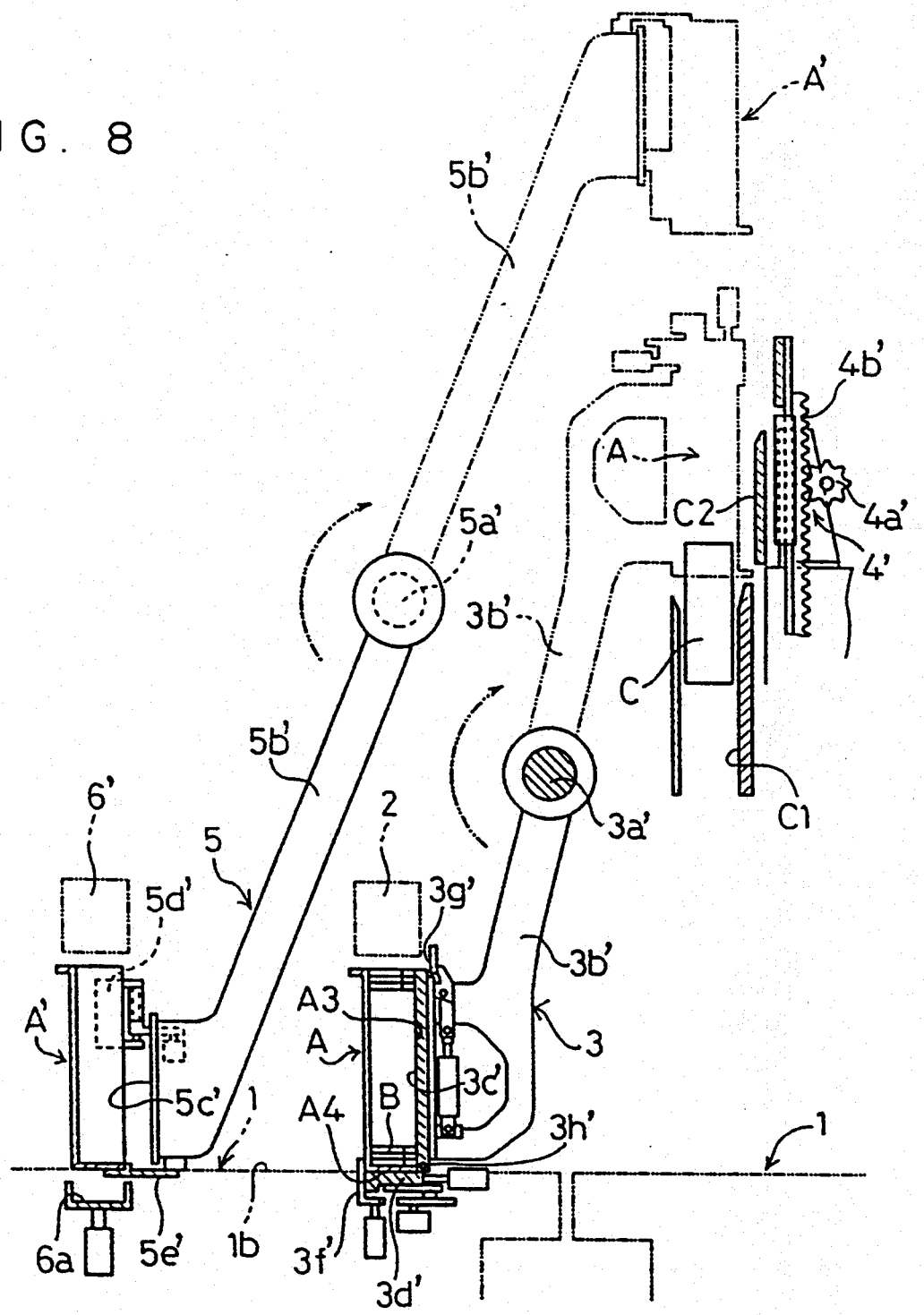
FIG. 8 is a vertical sectional front elevational view of another preferred bar-like article supplying apparatus and shows the apparatus immediately after a dolly travels forwardly.
Figure 9:
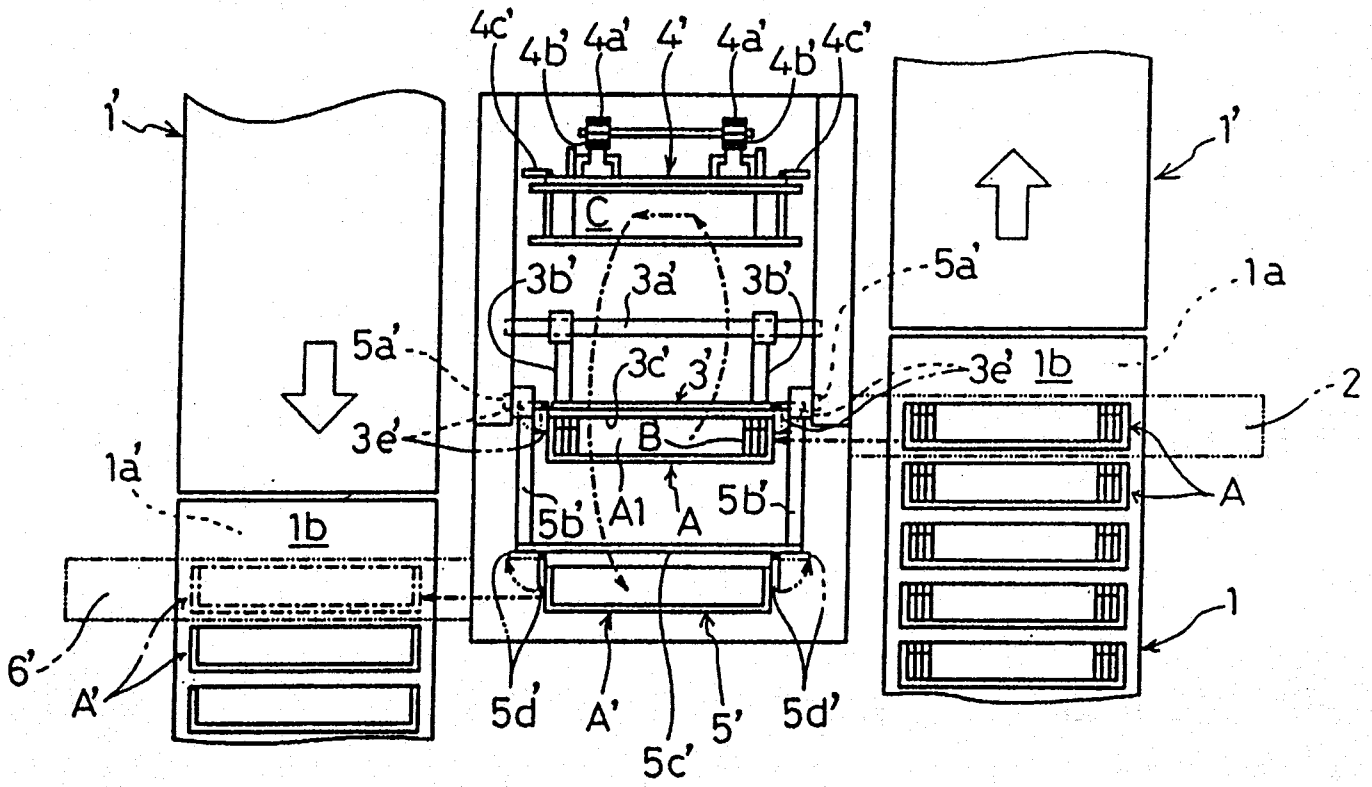
FIG. 9 is a reduced plan view of the apparatus of FIG. 8.
Figure 10:
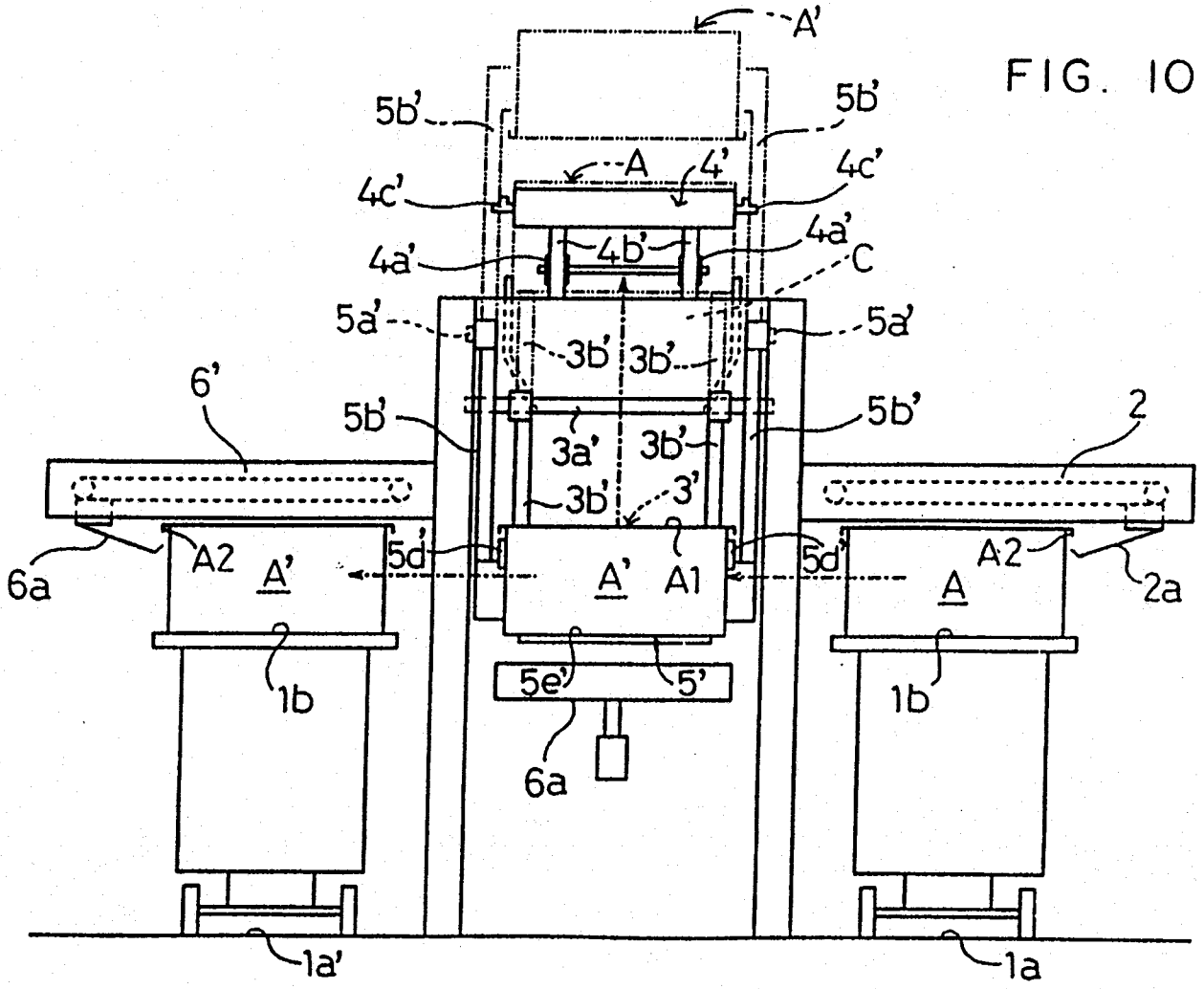
FIG. 10 is a reduced side elevational view of the apparatus of FIG. 8.

In another apparatus shown in FIGS. 8 to 10, a turning over center shaft 5*a* of an empty tray turning over mechanism 5′ is disposed in parallel substantially just above a turning over center shaft 3*a′* of an occupied tray turning over mechanism 3′ and the empty tray turning over mechanism 5′ is provided along the outer side of a route of rocking motion of the occupied tray turning over mechanism 3′ for rocking movement in the same direction. A lifting mechanism 4′ is disposed separately in an opposed relationship from a position at which the occupied tray turning over mechanism 3′ is turned over and moved up to another position in which the empty tray turning over mechanism 5′ is turned over and moved up, and an occupied tray A which has been put into an inverted condition just above a supply port C as a result of turning over and upward movement of the occupied tray turning over mechanism 3′ is transferred from a tray holding frame 3*c′* to and lifted by the lifting mechanism 4′. At a point of time when the occupied tray A thus lifted comes into a positional relationship wherein it does not interfere with rocking motion of the occupied tray turning over mechanism 3′, the occupied tray turning over mechanism 3′ is turned over and moved down while the empty tray A′ is transferred from the lifting mechanism 4′ moved up to the tray holder 5*c′* of the empty tray turning over mechanism 5′ to return it into an erected condition by turning over and downward movement.

In this instance, a cover plate 3*d′* on which a stopper 3*f′* mounted for advancing and retracting movement with respect to the tray holding frame 3*c′* of the occupied tray turning over mechanism 3′ is provided contiguously is supported for opening and closing movement, and a pair of holding pieces 4*c′*. 4*c′* mounted for movement into and out of contact with the left and right side faces A5, A5 of an occupied tray A, which has been put into an inverted condition by turning over and upward movement of the occupied tray turning over mechanism 3′, to engage and hold the occupied tray A are provided contiguously for opening and closing movement on racks 4b' of the lifting mechanism 4'. After turning over and upward movement of the occupied tray turning over mechanism 3' is completed, a cover plate 4d' is moved in an opening direction together with the retracted stopper 3f' as shown in FIG. 11 to allow the occupied tray A to be moved up, and simultaneously, the holding pieces 4c', 4c' of the lifting mechanism 4' which are waiting at their lower limit positions are closed to hold the occupied tray A during supply so that it cannot move.

Figure 12:
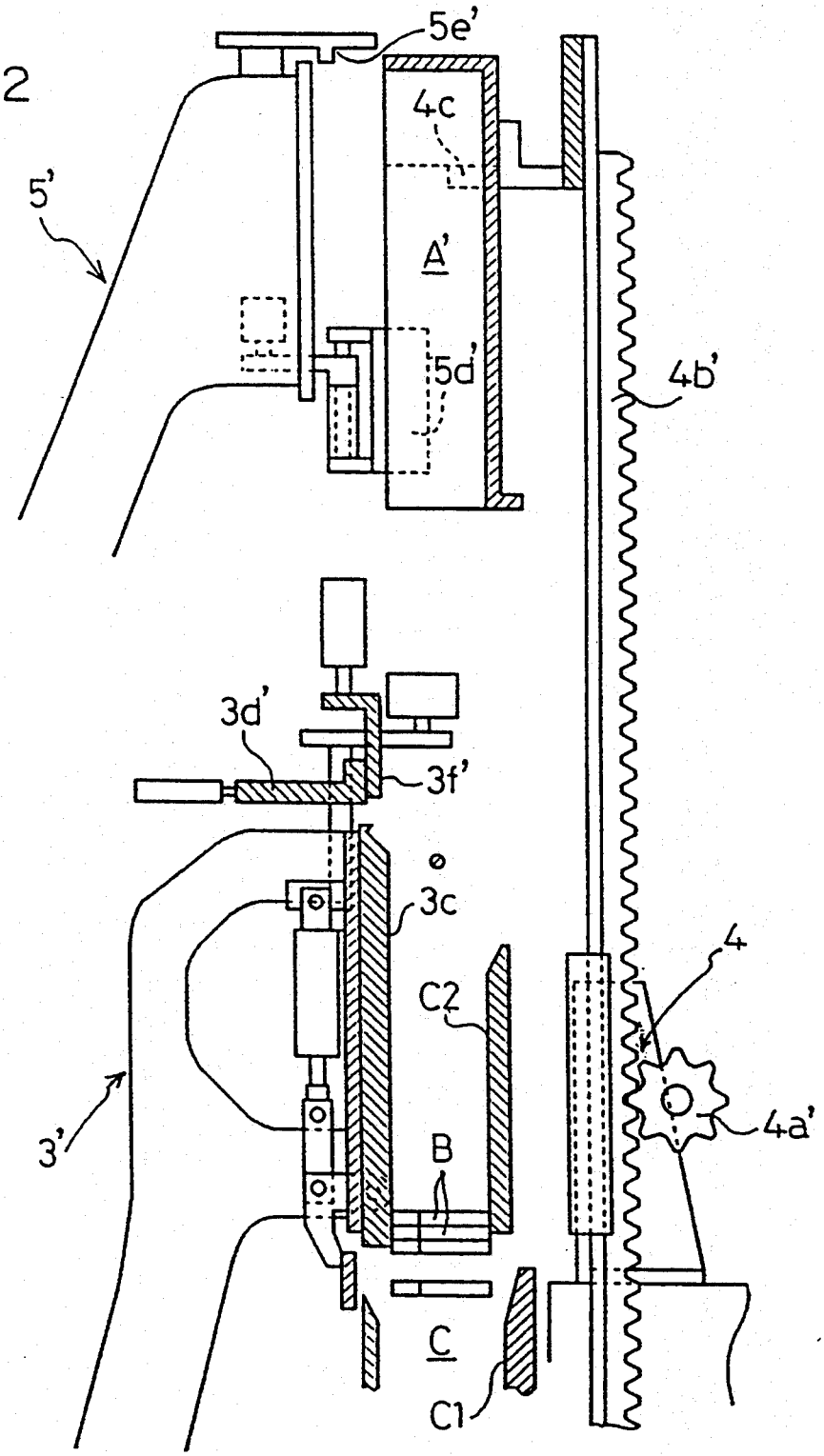
FIG. 12 is a partial enlarged vertical sectional front elevational view showing a condition immediately before transferring.

Thereafter, as rotation of pinions 4a' of the lifting mechanism 4' is started, the racks 4b' are moved up while holding the occupied tray A in an inverted condition, and at a point of time when the occupied tray A comes to a position in which it does not interfere with rocking motion of the occupied tray turning over mechanism 3', the holding pieces 5d', 5d' of the empty tray turning over mechanism 5' which are waiting at their upper limit positions as shown in FIG. 12 are moved into an opening direction to hold the empty tray A' so as not to move. Thereafter, the holding pieces 4c'. 4c' of the lifting mechanism 4' are moved into an opening direction to transfer the occupied tray A during supplying to the empty tray turning over mechanism 5'.

Accordingly, in the apparatus of FIGS. 8 to 10, since the occupied tray turning over mechanism 3' and the empty tray turning over mechanism 5' are disposed in a concentrated manner on one side of the supply port C, the entire apparatus can be made compact as compared with the apparatus of FIGS. 1 to 3, wherein the occupied tray turning over mechanism 3 and the empty tray turning over mechanism 5 are disposed at opposed positions across the supply port C, and the space on one side of the supply port C where the occupied tray turning over mechanism 3' and the empty tray turning over mechanism 5' are not disposed can be utilized effectively. If a packaging machine is disposed in the space, then bar-like articles B can be dropped and supplied from an occupied tray A directly into the hopper E of the packaging machine, and there is no need to provide transport belt D horizontally from the lower end of the supply port C to the hopper E of the packaging machine. Also the cost can be greatly reduced.

Further, in the apparatus shown in FIGS. 8 to 10, a transport passage 1a for dollies 1 on which occupied trays are placed and another transport passage 1a' for transport dollies 1' in an empty condition onto which empty trays A' are to be collected are disposed separately at opposed positions across the occupied tray turning over mechanism 3' and the empty tray turning over mechanism 5' such that an occupied tray A is carried into the occupied tray turning over mechanism 3' waiting at its lower limit position from a dolly 1 on the transport passage 1a by a carrying-in mechanism 2, whereas it is carried out from the empty tray turning over mechanism 5', turned over and moved down into a dolly 1' in an empty condition on the transport passage 1a' by a carrying out mechanism 6'.

Figure 13:
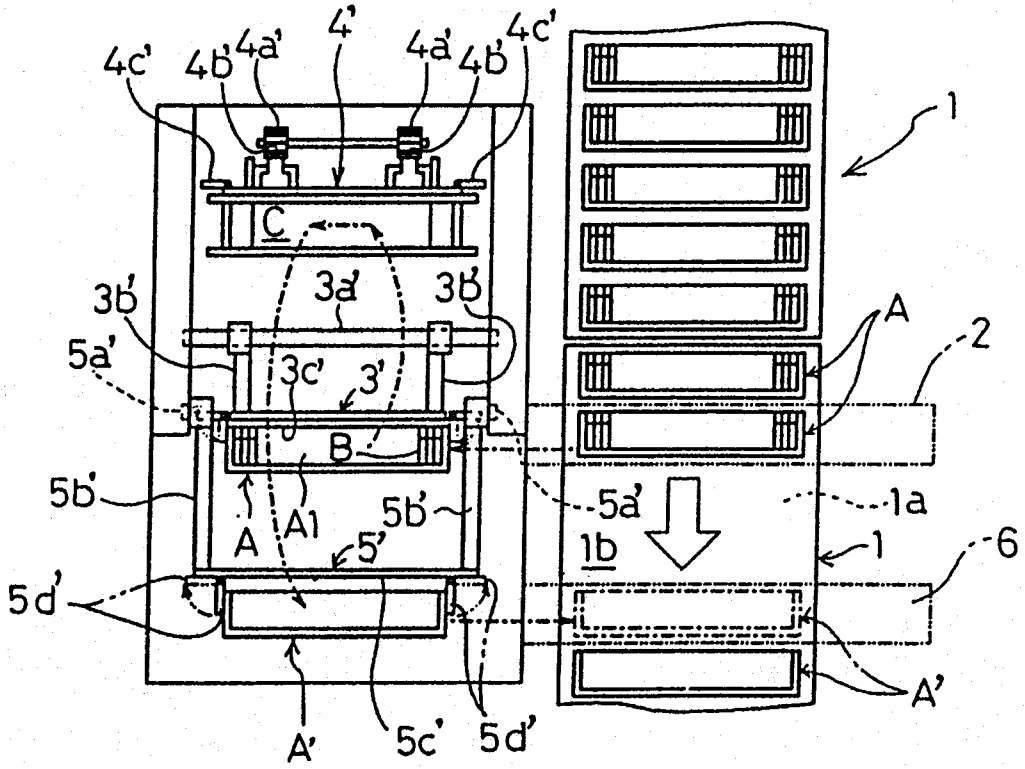
FIG. 13 is a plan view of a further preferred bar-like article supplying apparatus and shows the apparatus immediately after a dolly travels forwardly.

It is to be noted that, though not shown, the transport passage 1a is curved at an end thereof in the advancing direction and connected to the transport passage 1a' so that a dolly 1' in an empty condition may travel from the transport passage 1a to the transport passage 1a', or further, as shown in FIG. 13, an occupied tray A is carried into the occupied tray turning over mechanism 3' from a dolly 1 on the transport passage 1a by the carrying-in mechanism 2, whereas it is carried Out from the empty tray turning over mechanism 5' to a dolly 1' in an empty condition by the carrying-out mechanism 6.

Further, while the supply port C is disposed at a position higher than the upper face 1b of a dolly 1 onto which a tray A is to be placed, the disposition is not limited to this, and, for example, the upper face 1b of a dolly 1 and the supply port C may be disposed substantially at same height positions.

INDUSTRIAL APPLICABILITY OF THE INVENTION

As described above, a bar-like article supplying apparatus according to the present invention can supply, as compared with a conventional apparatus wherein bar-like articles cannot be supplied from a dolly to a supply port without passing two carrying-in steps, a turning and upwardly moving step and a turning over step, bar-like articles to the supply port only by passing one carrying-in step and a turning over step. Also, the construction of the apparatus is simplified as much and the entire apparatus becomes compact and besides, the cost can be reduced. Further, as compared with the conventional apparatus wherein it is necessary, after an empty tray is carried out from a rotary member to a lift, holder during supplying of bar-like articles from the tray, to turn over and move up and down the empty tray and a next tray and further to carry the next tray from the lift holder into the rotary member to prepare the next tray, preparations of a tray are completed only by turning over an occupied tray turning over mechanism back and carrying in the next tray. Even if the processing rate of bar-like articles supplied is raised so that the time after starting until completion of supply of the bar-like articles is shortened, bar-like articles can be supplied successively corresponding to this and consequently, an entire increase in rate can be achieved.

We claim:

1. A bar-like article supplying apparatus comprising a carrying-in mechanism for carrying in a tray, said tray being open at least at an upper face thereof, from a dolly which moves intermittently, while leaving the tray in an erected condition, an occupied tray turning over mechanism for turning over and feeding the tray thus carried in and dropping and supplying bar-like articles from the tray into a supply port, said supply port including a longitudinal axis, an empty tray turning over mechanism for turning over and feeding the tray in an inverted condition back into the erected condition, and a carrying-out mechanism for carrying out the empty tray to be returned into the erected condition into a dolly while leaving the empty tray in the erected condition, said occupied tray turning over mechanism including an occupied tray turning over center shaft, and said empty tray turning over mechanism including an empty tray turning over center shaft, said occupied tray turning over center shaft and said empty tray turning over center shaft being provided for allowing individual rocking motion of said occupied tray turning over mechanism and said empty tray turning over tray mechanism, respectively, and the tray turned over by said occupied tray turning over mechanism being transferred from said occupied tray turning over mechanism to said empty tray turning over mechanism just above said supply port, wherein said turning over center shaft of said occupied tray turning over mechanism and said turning over center shaft of said empty tray turning over mechanism are disposed in parallel to each other and to said longitudinal axis of said supply port.

2. A bar-like article supplying apparatus according to claim 1, wherein said turning over center shaft of said occupied tray turning over mechanism and said turning over center shaft of said empty tray turning over mechanism are disposed at positions opposed to each other across said supply port.

3. A bar-like article supplying apparatus according to claim 1, wherein said turning over center shaft of said empty tray turning over mechanism is disposed in parallel substantially just above said turning over center shaft of said occupied tray turning over mechanism and said empty tray turning over mechanism is rocked in the same direction along an outer side of a path of rocking motion of said occupied tray turning over mechanism.

4. A bar-like article supplying apparatus according to claim 1, wherein said occupied tray turning over mechanism includes a rocking arm being provided projectingly for rocking motion in upward and downward directions on said occupied tray turning over center shaft which is intermittently driven to rotate in forward and reverse directions, and a tray holding frame for removably holding the tray being provided contiguously at an end of said rocking arm, and said empty tray turning over mechanism including a rocking arm being provided projectingly for rocking motion in upward and downward directions on said empty tray turning over center shaft which is intermittently driven to rotate in forward and reverse directions, and a tray holder for removably holding the tray being provided contiguously at an end of said rocking arm.

5. A bar-like article supplying apparatus according to claim 1, wherein a lifting mechanism for moving up the tray turned over by said occupied tray turning mechanism just above said supply port while leaving the tray in the inverted condition is provided between said occupied tray turning over mechanism and said empty tray turning over mechanism.

6. A bar-like article supplying apparatus according to claim 1, wherein said occupied tray turning over mechanism includes a rocking arm being provided projectingly for rocking motion in upward and downward directions on said occupied tray turning over center shaft which is intermittently driven to rotate in forward and reverse directions, and a tray holding frame for removably holding the tray being provided contiguously at an end of said rocking arm while said empty tray turning over mechanism includes a rocking arm being provided projectingly for rocking motion in upward and downward directions on said empty tray turning over center shaft which is intermittently driven to rotate in forward and reverse directions, and a tray holder for removably holding the tray being provided contiguously at an end of said rocking arm and a lifting mechanism for moving up the tray turned over by said occupied tray turning mechanism just above said supply port while leaving the tray in the inverted condition being provided between said occupied tray turning over mechanism and said empty tray turning over mechanism.

7. A bar-like article supplying apparatus according to claim 1, wherein said carrying-in mechanism for carrying the tray from said dolly into said occupied tray turning over mechanism and said carrying-out mechanism for carrying out the empty tray from said empty tray turning over mechanism into said dolly are both located on the same side of said occupied tray turning over mechanism and said empty tray turning over mechanism.

8. A bar-like article supplying apparatus according to claim 1, wherein a lifting mechanism for moving up the tray turned over by said occupied tray turning mechanism while leaving the tray in the inverted condition is provided between said occupied tray turning over mechanism and said empty tray turning over mechanism.

9. A bar-like article supplying apparatus according to claim 1, wherein said occupied tray turning over mechanism includes a rocking arm being provided projectingly for rocking motion in upward and downward directions on said occupied tray turning over center shaft which is intermittently driven to rotate in the forward and reverse directions, and a tray holding frame for removably holding the tray being provided contiguously at an end of said rocking arm, said empty tray turning over mechanism including a rocking arm being provided projectingly for rocking motion in upward and downward directions on said empty tray turning over center shaft which is intermittently driven to rotate in the forward and reverse directions, and a tray holder for removably holding the tray being provided contiguously at an end of said rocking arm, and lifting mechanism for moving up the tray turned over by said occupied tray turning mechanism just above said supply port while leaving the tray in the inverted condition being provided between said occupied tray turning over mechanism and said empty tray turning over mechanism.

10. A bar-like article supplying apparatus according to claim 1, wherein said carry-in mechanism carries a tray from the dolly at substantially the same vertical height that said carrying-out mechanism returns the empty tray to the dolly.

* * * * *